US009117360B1

(12) United States Patent
Conforti

(10) Patent No.: US 9,117,360 B1
(45) Date of Patent: Aug. 25, 2015

(54) LOW BATTERY TROUBLE SIGNAL DELAY IN SMOKE DETECTORS

(71) Applicant: Fred Conforti, Lisle, IL (US)

(72) Inventor: Fred Conforti, Lisle, IL (US)

( * ) Notice: Subject to any disclaimer, the term of this patent is extended or adjusted under 35 U.S.C. 154(b) by 0 days.

(21) Appl. No.: 14/297,904

(22) Filed: Jun. 6, 2014

(51) Int. Cl.
*G08B 17/00* (2006.01)
*G08B 29/18* (2006.01)
*G08B 17/10* (2006.01)

(52) U.S. Cl.
CPC ..... *G08B 29/181* (2013.01); *G08B 17/10* (2013.01)

(58) Field of Classification Search
None
See application file for complete search history.

(56) References Cited

U.S. PATENT DOCUMENTS

| | | | | |
|---|---|---|---|---|
| 4,138,670 | A * | 2/1979 | Schneider et al. | 340/507 |
| 4,287,517 | A * | 9/1981 | Nagel | 340/636.15 |
| 4,313,110 | A * | 1/1982 | Subulak et al. | 340/527 |
| 4,514,720 | A | 4/1985 | Oberstein et al. | |
| 4,785,283 | A | 11/1988 | Yuchi | |
| 4,796,205 | A | 1/1989 | Ishii et al. | |
| 4,884,222 | A | 11/1989 | Nagashima et al. | |
| 5,103,096 | A | 4/1992 | Wong | |
| 5,155,468 | A | 10/1992 | Stanley et al. | |
| 5,369,397 | A | 11/1994 | Wong | |
| 5,453,749 | A | 9/1995 | Morita | |
| 5,592,147 | A | 1/1997 | Wong | |
| 5,691,704 | A | 11/1997 | Wong | |
| 5,736,928 | A | 4/1998 | Tice et al. | |
| 5,764,142 | A | 6/1998 | Anderson et al. | |
| 5,767,776 | A | 6/1998 | Wong | |
| 5,798,700 | A | 8/1998 | Wong | |
| 5,864,286 | A | 1/1999 | Right et al. | |
| 5,917,417 | A | 6/1999 | Girling et al. | |
| 5,966,077 | A | 10/1999 | Wong | |
| 6,081,197 | A * | 6/2000 | Garrick et al. | 340/636.1 |
| 6,329,924 | B1 * | 12/2001 | McNulty | 340/660 |

(Continued)

FOREIGN PATENT DOCUMENTS

| | | |
|---|---|---|
| JP | 001237797 | 9/1989 |
| JP | 002032498 | 2/1990 |

(Continued)

OTHER PUBLICATIONS

Hans-Christian Muller, "A New Approach to Fire Detection Algorithms based on the Hidden Markov Model," published in the proceedings of the 12th International Conference on Automatic Fire Detection, which took place on Mar. 25-28, 2001, in Gaithersburg, Maryland USA.

*Primary Examiner* — Julie Lieu
(74) *Attorney, Agent, or Firm* — Greer, Burns & Crain Ltd.

(57) ABSTRACT

The present invention provides a low battery trouble signal delay circuit for a smoke detector configured for periodically measuring environmental conditions and for producing a fire alarm signal when smoke is detected in the environment. The trouble signal delay circuit has a battery, a comparator configured for receiving a voltage measurement signal from the battery and a reference voltage measurement signal and sending a resulting signal to an activator circuit, at least one activator in the activator circuit that is user activated upon receiving a first input; and at least one low battery trouble signal annunciator connected to the activator circuit and configured for indicating that the voltage measurement signal is below the reference voltage measurement after receiving a signal from the comparator. The activator temporarily disables the low voltage trouble signal when activated for a silencing time period, while maintaining the operation of the fire alarm signal.

10 Claims, 14 Drawing Sheets

(56) References Cited

U.S. PATENT DOCUMENTS

| | | | | |
|---|---|---|---|---|
| 7,412,356 | B1 | 8/2008 | Dzenitis et al. | |
| 8,152,732 | B2 | 4/2012 | Lynn et al. | |
| 2002/0044061 | A1* | 4/2002 | Johnston et al. | 340/628 |
| 2002/0130782 | A1* | 9/2002 | Johnston et al. | 340/628 |
| 2005/0200475 | A1 | 9/2005 | Chen | |
| 2006/0007010 | A1 | 1/2006 | Mi et al. | |
| 2006/0103540 | A1* | 5/2006 | Rutter et al. | 340/628 |
| 2006/0115154 | A1 | 6/2006 | Chen | |
| 2006/0267756 | A1 | 11/2006 | Kates | |
| 2006/0273896 | A1 | 12/2006 | Kates | |
| 2008/0183433 | A1 | 7/2008 | Dzenitis et al. | |
| 2010/0085199 | A1 | 4/2010 | Gonzales | |
| 2011/0018726 | A1 | 1/2011 | Gonzales | |

FOREIGN PATENT DOCUMENTS

| | | |
|---|---|---|
| JP | 05073781 | 3/1993 |
| JP | 05242377 | 9/1993 |
| JP | 009161169 | 6/1997 |
| JP | 02008077303 | 4/2008 |
| WO | 9604625 | 2/1996 |

* cited by examiner

LOW BATTERY TROUBLE SIGNAL DELAY IN SMOKE DETECTORS

FIELD OF THE INVENTION

The present invention pertains to smoke and/or carbon monoxide detectors that are powered by AC voltage with a battery backup. More particularly, it pertains to types of smoke detectors that give off an audible trouble signal, usually in the form of an intermittent beep, when the battery power is low.

BACKGROUND

Common smoke detectors are designed to provide a warning by generating a visual and/or audible alarm. Smoke detectors are powered by alternating current (AC), batteries or a combination of both. AC-powered smoke detectors with battery backup are typically considered to be the primary detectors, while smoke detectors powered by batteries alone are considered to be supplemental detectors.

Both smoke detectors powered only with a battery, as well as AC-powered smoke detectors with battery backup usually generate a low battery trouble signal once the battery power diminishes below a prescribed level. The low battery trouble signal is typically a single short horn beep emitted at regular intervals, such as every minute. A benefit of the low battery trouble signal is that it alerts the home dweller or user that the battery power is low and that the battery needs to be replaced. In most cases, there is a time period ranging from days to a week of battery power remaining before the detector is inoperable on battery power alone. Thus, there is ample time for the user to replace the battery after being alerted by the low battery trouble signal.

One drawback with conventional AC-powered with battery backup type smoke detectors is that once the low battery trouble signal is initiated, the trouble signal continues until the battery is replaced. This situation can occur if there is no new battery on hand. In a battery-powered detector, removing the battery will stop the signal, but renders the detector useless in a fire situation. In an AC-powered detector with battery backup, the detector will typically continue to emit the trouble signal once the battery is removed. Thus, in the AC-powered with battery backup case, the only recourse to stop the trouble signal is to shut off the AC power to the detector or disconnect the detector.

SUMMARY

The above-listed needs are met by the present smoke detector, which features the capability of temporarily disabling a low battery trouble signal, which is distinguished from the main smoke alarm emitted by the detector for a predetermined time until the battery can be replaced. While the low battery trouble signal is disabled, the core smoke-detecting and alarm function of the smoke detector is retained. In the preferred embodiment, an operational circuit of the smoke alarm is provided with an operator-controlled activator that changes a measured voltage value that is indicative of battery strength, so that the circuit operates as if the battery is at acceptable power. While "hush button" features exist to temporarily silence the fire alarm in situations such as nearby cooking, no equivalent system exists for temporarily silencing the low battery trouble signal.

More particularly, the present invention provides a low battery trouble signal delay circuit for a smoke detector configured for periodically measuring environmental conditions and for producing a fire alarm signal when smoke is detected in the environment. The low battery trouble signal delay circuit has a battery, a comparator configured for receiving a voltage measurement signal from the battery and a reference voltage measurement signal and sending a resulting signal to an activator circuit, at least one activator in the activator circuit that is user activated upon receiving a first input; and at least one low battery trouble signal annunciator connected to the activator circuit and configured for indicating that the voltage measurement signal is below the reference voltage measurement after receiving a signal from the comparator. The activator temporarily disables the low battery trouble signal when activated for a silencing time period, while maintaining the operation of the fire alarm signal.

In another embodiment, the present invention provides a low battery trouble signal circuit for a smoke detector configured for periodically measuring environmental conditions and for producing a fire alarm signal when smoke is detected in the environment. The low battery trouble signal circuit has a battery, a comparator configured for receiving a voltage measurement signal from the battery and a reference voltage measurement signal and sending a resulting signal to an activator circuit, at least one activator in the activator circuit that is user activated upon receiving a first input; and at least one low battery trouble signal annunciator connected to the activator circuit and configured for indicating that the voltage measurement signal is below the reference voltage measurement after receiving a signal from the comparator. The low battery trouble signal delay circuit temporarily changes the voltage measurement signals the comparator receives and disables the low battery trouble signal when activated for a silencing time period.

In yet another embodiment, a method for temporarily silencing a low battery trouble signal in a smoke detector is provided. A comparator and an activator circuit are provided. The comparator periodically receives a voltage measurement signal from a battery in the smoke detector, and compares the voltage measurement signal to a reference voltage signal and sends a resulting signal to the activator circuit. The activator circuit activates a low battery trouble signal when the voltage measurement signal is less than the reference voltage signal, and the circuit checks for an activating event after the activation of the low battery trouble signal. If the activating event occurred, the low battery trouble signal is disabled for a silencing time period and the receiving, comparing, enabling, and checking steps are repeated.

DETAILED DESCRIPTION

Figure 1:
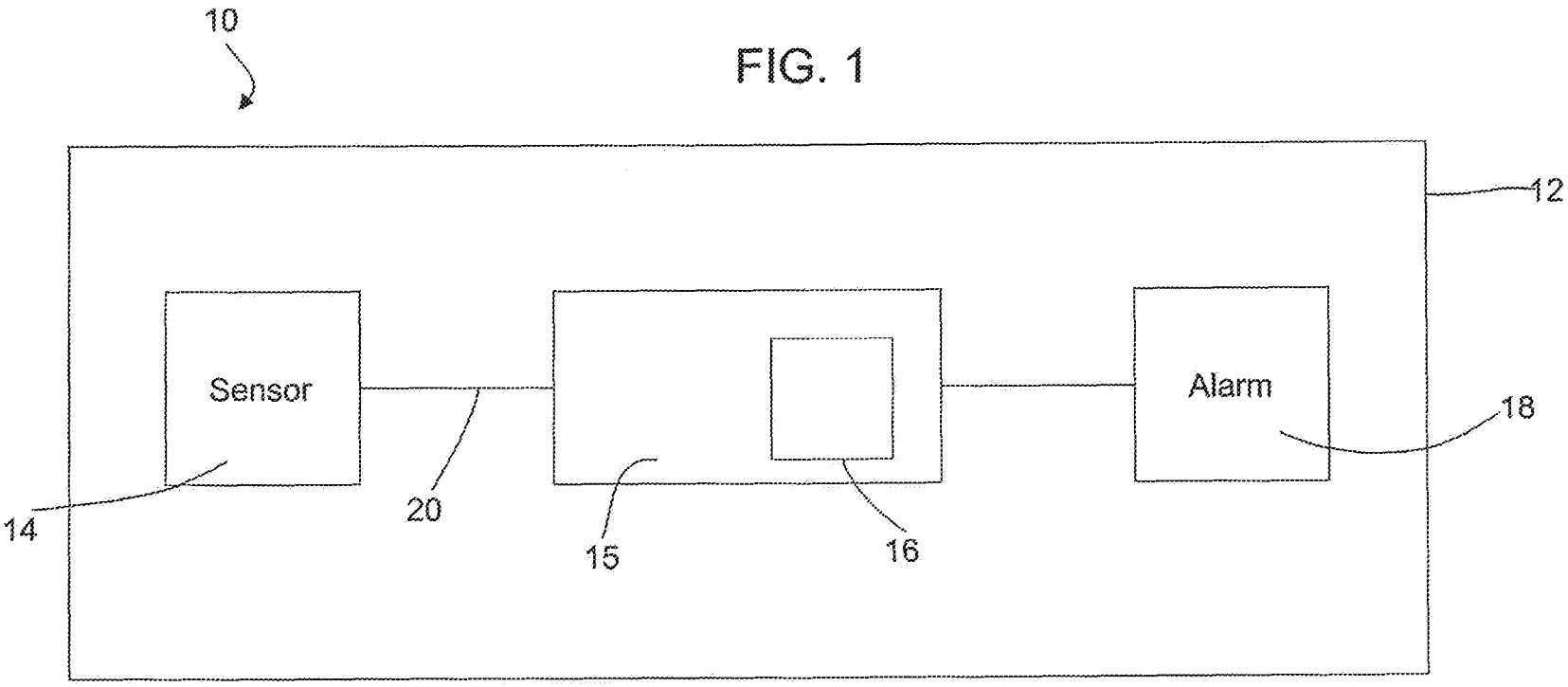
FIG. 1 PRIOR ART
FIG. 1 is a schematic of a conventional smoke detector.

As shown in FIG. 1, a smoke detector is generally designated as 10, with all internal components being at least partially contained within a common housing 12. Associated with the housing 12 is a fire sensor 14 connected to a control unit 15, including a portion 16, having at least one of a microprocessor, an Application Specific Integrated Circuit (ASIC), and an electrical circuit, all of which collectively referred to here as "activator circuit" and an alarm annunciator 18, also connected to the activator circuit. The fire sensor 14 is configured for taking periodic readings of environmental conditions, and is contemplated as producing a fire alarm signal when smoke is detected in the environment. It is contemplated that the fire sensor 14 is either a single ionization or photoelectric sensor, both of which are well known. Alternative types of the fire sensor 14 may also be used, including a carbon dioxide ($CO_2$) sensor and carbon monoxide (CO) sensor. Further, it is contemplated that multiple types of fire sensors 14 may be used in combination to enhance the ability of the smoke detector 10 to detect fires.

The activator circuit 16 may be any electronic processing device configured for processing an output signal 20 of the sensor 14 and implementing the algorithms or logic described here. Although it is preferred that a single activator circuit 16 be used, the use of multiple circuits is contemplated. The annunciator 18 is configured for outputting multiple sounds with various volumes and tones depending on output of the activator circuit 16. However, multiple annunciators 18 may be used, depending on the application.

Figure 2:
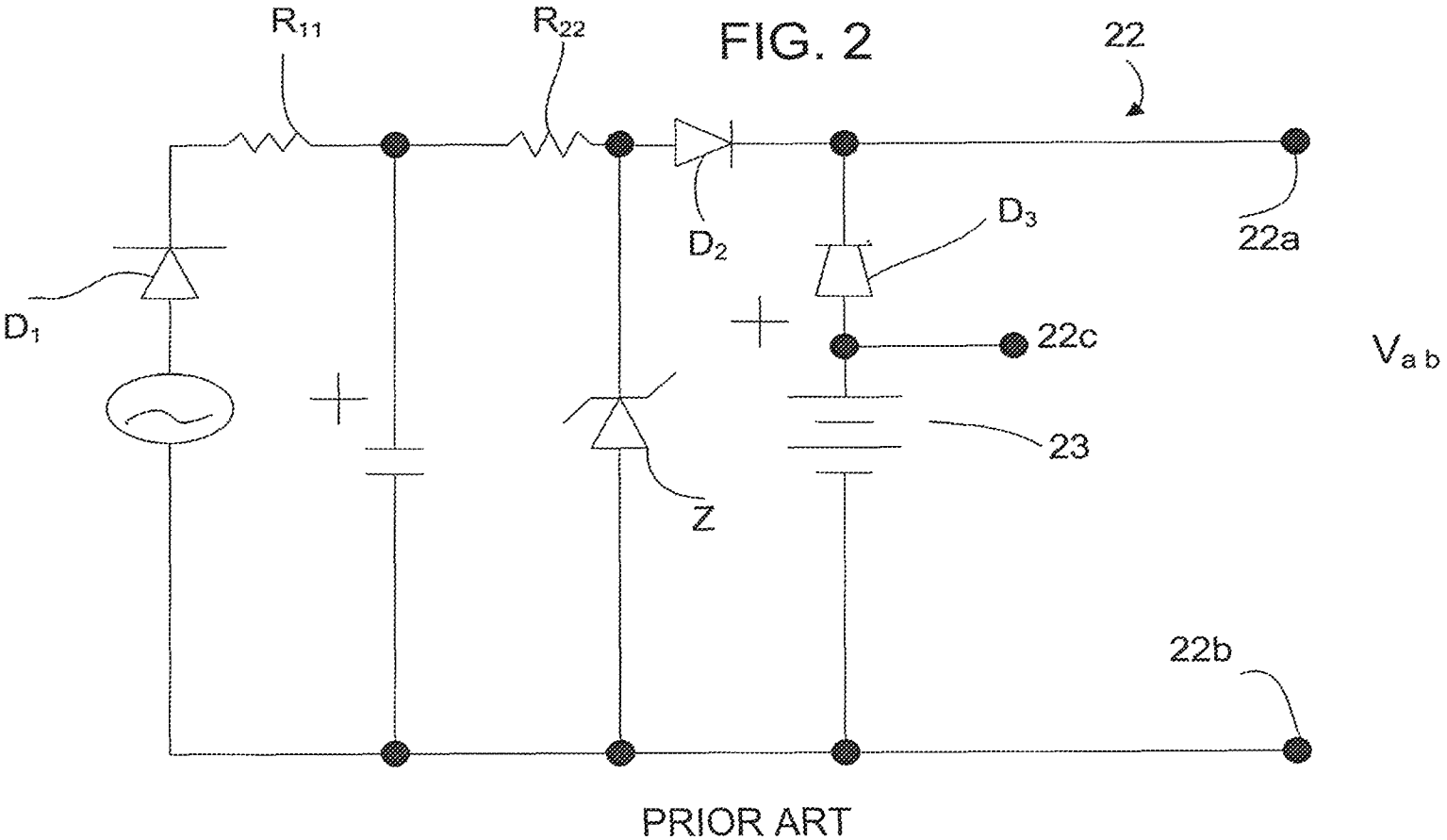
FIG. 2 PRIOR ART
FIG. 2 is a schematic of a circuit including an alternating current power supply with battery backup for the conventional smoke detector of FIG. 1.

Referring now to FIG. 2, a conventional AC power supply with a battery backup circuit is generally designated 22 and is configured for powering the smoke detector 10. In this configuration, the AC voltage is the primary power supply for the smoke detector 10 and a power source, such as a battery 23, is the backup power supply. Alternatively, the smoke detector 10 may be exclusively powered by the battery 23. Such power supply circuits 22 and associated components are well known in the art and are typically housed within the detector housing 12. Supply voltage is provided at terminals 22*a*, 22*b*. Battery capacity is measured between terminals 22*b* and 22*c*.

Figure 3A:
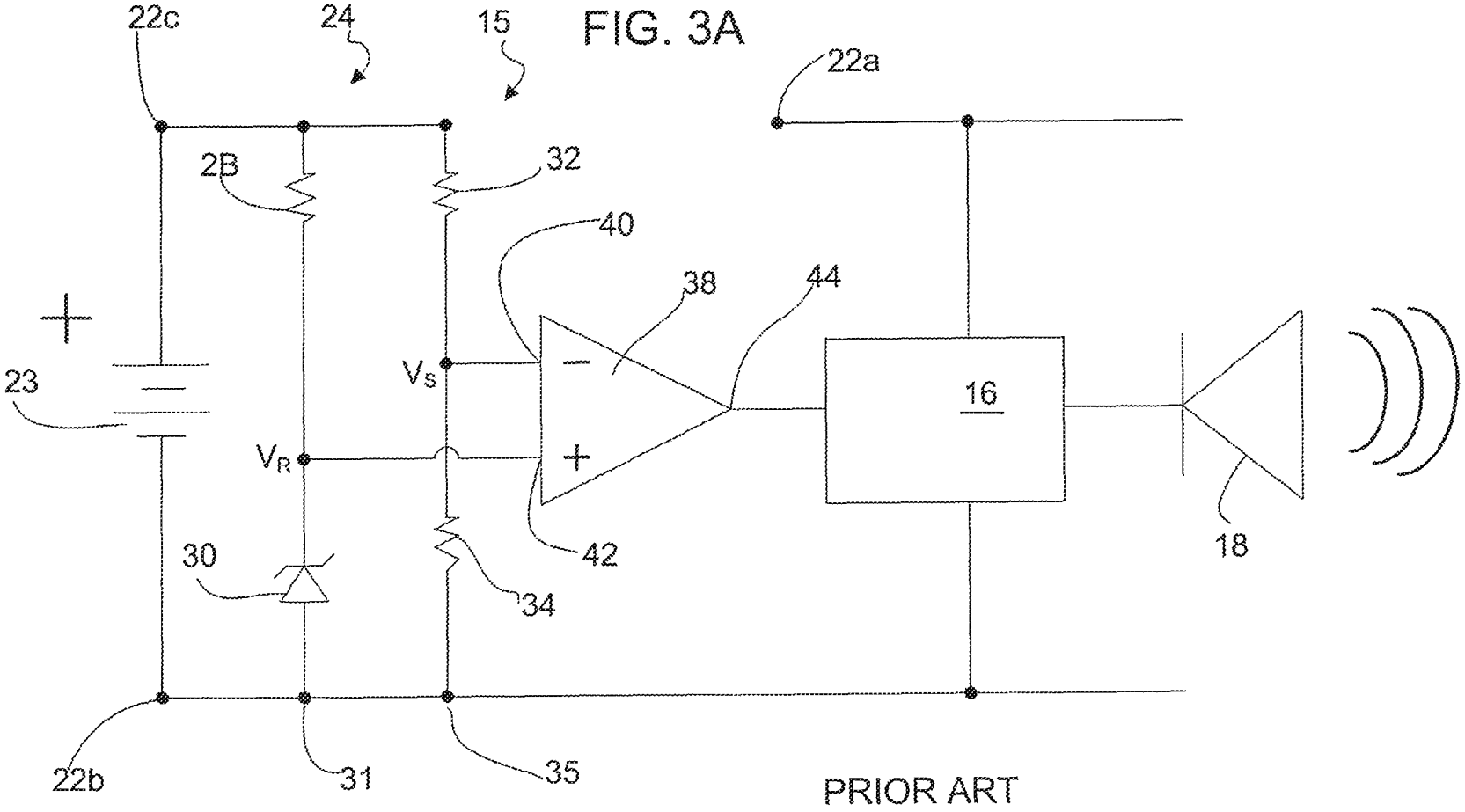
FIG. 3A is a circuit diagram for a conventional low battery voltage sensing circuit system.

FIG. 3A illustrates a conventional low battery voltage sensing circuit, generally designated 24, commonly used in smoke detectors 10 to detect low battery power. Power is supplied from the power supply 22 at terminals 22*b*, 22*c*. It is contemplated that the power supply 22 can be a battery 23 alone, or as depicted in FIG. 2, an AC-power battery pack including a battery as battery backup. The low battery voltage sensing circuit 24 includes a first resistor 28 and a zener diode 30 connected in series to each other and in parallel with the battery to form a first voltage divider 31. The voltage measured at the first voltage divider 31 is also referred to as the reference voltage, $V_R$. A second resistor 32 and a third resistor 34 are connected in series to each other and form a second voltage divider 35. Voltage measured at the second voltage divider 35 is referred to as the sensed voltage, $V_S$. The first voltage divider 31 and the second voltage divider 35 are connected in parallel to each other as well as to the power source 23.

Each of the voltage dividers 31, 35 is connected as the input to a comparator 38. The first voltage divider 31 is preferably connected to the negative terminal 40 of the comparator 38, and the second voltage divider 35 is preferably connected to a positive terminal 42 of the comparator. An output 44 of the comparator 38 is connected to the activator circuit 16, which is connected to the annunciator 18.

Voltage, $V_R$, measured in the first voltage divider 31 will remain relatively constant, because the voltage of the zener diode 30 will remain relatively constant. As such, the first resistor 28 and the zener diode 30 are selected to generate an appropriate reference voltage. The resistance value of the zener diode 30 is selected based on the battery manufacturers' specifications for the battery's end of life voltage under load for a long and useful battery life, by activating a low battery trouble signal when the battery power is low but not fully depleted. The resistance values of the resistors in the voltage divider 35 are high ohm values to reduce drain on the battery. Resistor 28 is selected to match the zener diode current requirements. Likewise, the values of the second resistor 32 and the third resistor 34 in the second voltage divider 35 are selected so that the sensed voltage will fall below the reference voltage when the loaded battery voltage reading falls below the reference voltage.

Figure 3B:
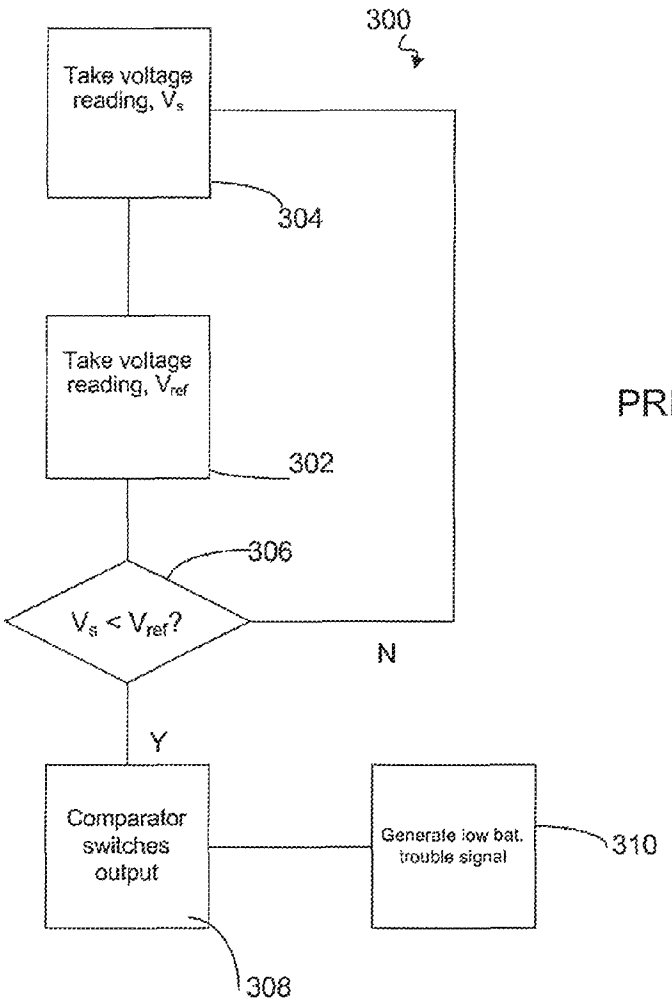
FIG. 3B PRIOR ART
FIG. 3B is a flowchart describing the operation of the conventional low battery voltage sensing circuit system of FIG. 3A.

Moving now to FIG. 3B, a flowchart showing the operation of the low battery voltage sensing circuit 24, including the activator circuit 16, is generally designated as 300. In conventional detectors, the battery 23 has a load applied approximately once every minute and the capacity of the battery is sensed during the battery loading time. When the load is applied, the comparator 38 will take readings of the reference voltage in the first voltage divider 31 at 302 and the sensed voltage in the second voltage divider 35 at 304. The comparator 38 then compares 306 the reference voltage 31 to the sensed voltage 35 to determine which voltage is greater. If the sensed voltage is larger than the reference voltage, the system continues to take periodic voltage measurements at 302, 304. If the sensed voltage 35 is less than the reference voltage 31, the comparator 38 switches its output to indicate that the reference voltage is larger at 308 to the activator circuit 16. The activator circuit 16 then emits the low battery trouble signal through the low battery trouble signal annunciator 18.

Figure 4A:
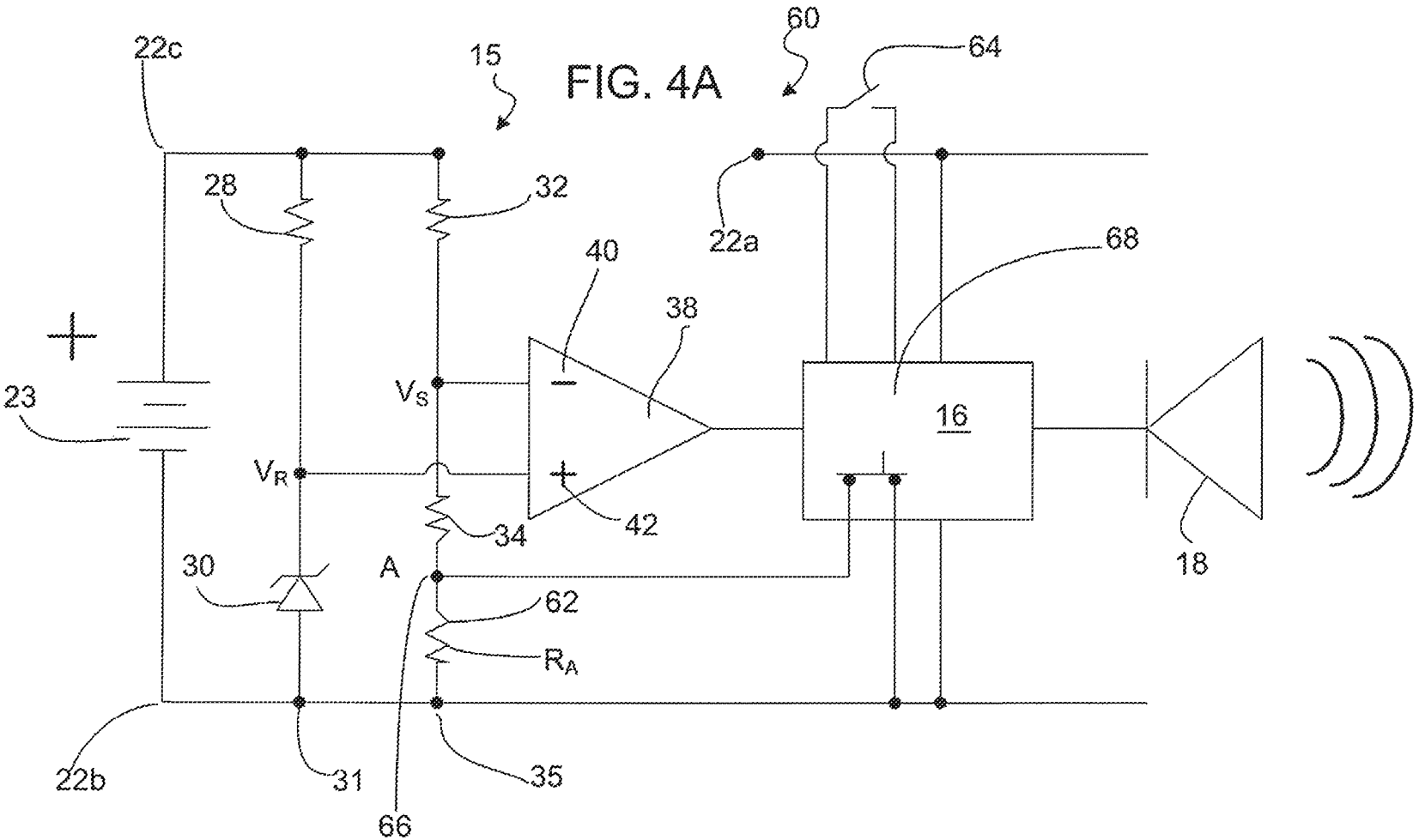
FIG. 4A is a circuit diagram for one embodiment of the present detector.

Referring now to FIG. 4A, a first embodiment of the present low battery sensing circuit is generally designated 60. The circuit 60 is similar to the prior art low battery sensing circuit 24, and shared components are designated with identical reference numbers. Included in the circuit 60 is an additional resistor $R_A$ 62 positioned between the resistor 34 and 22*b*, ground. The resistor $R_A$ 62 is connected to the second and third resistors 32 and 34 in series and has a relatively small resistance in comparison to the second and third resistors 32 and 34. It is contemplated that the resistance value of resistor $R_A$ 62 is in the range of 2-5% of the resistance value sum of resistors 32 and 34.

The circuit 60 also includes an activator 64, here depicted schematically as a trouble signal delay switch, connected to the activator circuit 16 and to the second voltage divider 35 between the second resistor 34 and the resistor $R_A$ 62, referred to as junction A 66. The activator circuit 16 operates a switch, schematically depicted at 68, configured to toggle between an open and closed position depending on the position of switch 64. In the closed position of the switch 68, the corresponding voltage at junction A 66 is grounded. When the activator 64 is activated, the switch 68 is in the open position, the junction A 66 is ungrounded.

Figure 4B:
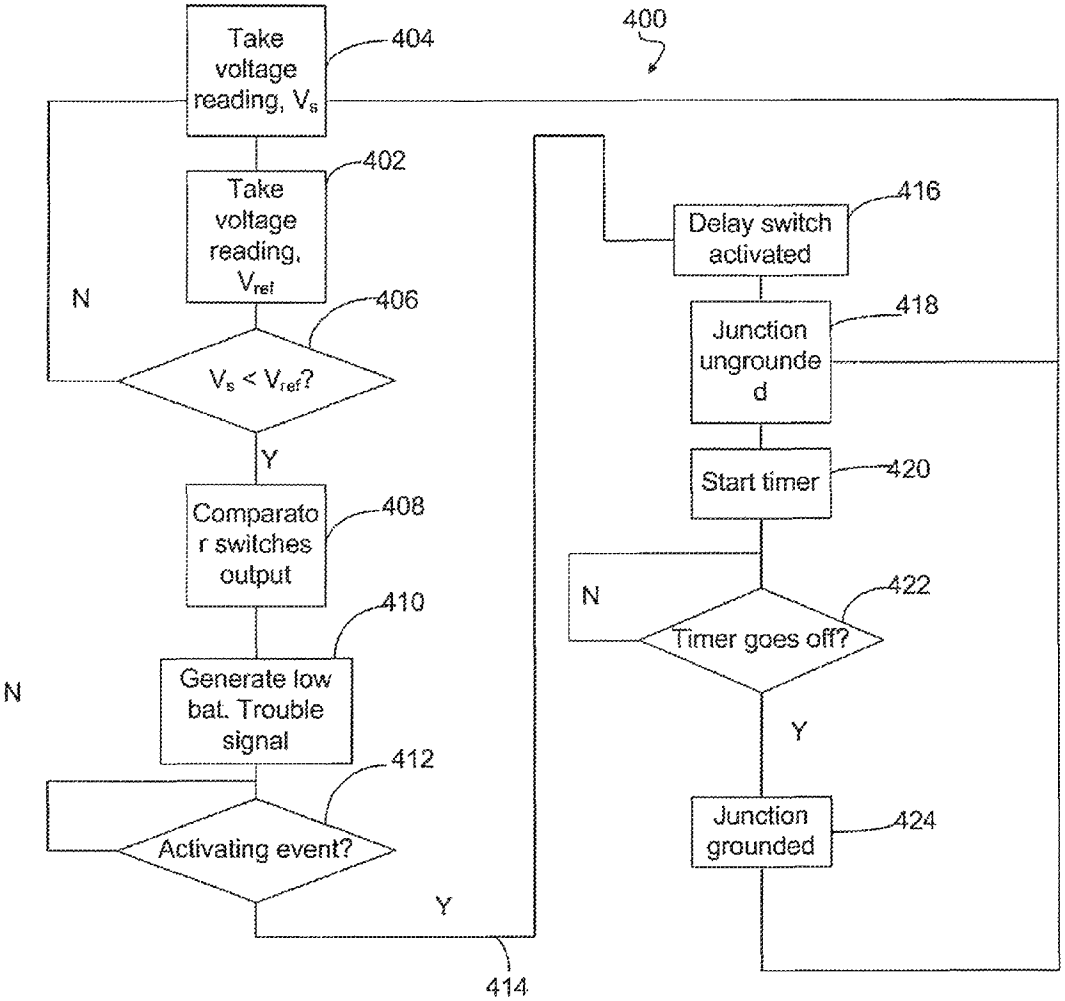
FIG. 4B is a flowchart describing the operation of FIG. 4A.

Referring now to FIG. 4B, operation of the first delay switch circuit 60 is generally designated as 400. Steps 402-

410 are identical to steps 302-310 showing the operation of the low battery voltage sensing circuit 300. However, once the comparator 38 generates the low voltage signal to the activator circuit 16 to activate the low battery trouble signal at 410, the delay circuit 60 checks for an activating event at 412, in which the delay switch 64 is activated upon receiving a first input. Examples of the activating event at 414 include removing the battery 23 from the detector 10. Additional examples of the activating event 414 are described below. If no activating event 414 has occurred, the low battery trouble signal is sounded at 18. If the activating event occurs 414, by the delay switch 64 being activated at 416, the junction A 66 is ungrounded at 418.

Since junction A 66 is ungrounded, the voltage, $V_S$, at the second voltage divider 35 increases. Therefore, the increase in sensed voltage, $V_S$, at the second voltage divider 35 makes it seem as though the battery voltage from the voltage source 23 has not decreased when the system is repeating the sensed and reference voltage measurements at 402, 404. The comparator 38 receives the sensed voltage in the second voltage divider 35 and the reference voltage in the first voltage divider 31, and compares the two voltages at 406. Thus, the comparator 38 indicates that the sensed voltage is higher than the reference voltage when the delay switch 64 is activated, and there is no change in output of the comparator 38. Without the change in comparator output, the activator circuit 16 does not activate the low battery trouble signal.

When the delay switch 64 is activated by removing the battery 23 or pushing a button after the battery has been removed at 416, a timer in the activator circuit 16 starts at 420. The timer in the activator circuit 16 keeps the switch 68 connecting junction 66 to ground open for a silencing time period until the timer in the activator circuit 16 times out at 422. After the timer in the activator circuit 16 times out 422, the switch 68 is closed, causing junction 66 to be grounded again at 424. Therefore, the sensed voltage at junction 40 decreases. When the system 400 again takes the sensed and reference voltage measurements at 402, 404, the comparator 38 compares the decreased sensed voltage and the reference voltage at 406. When the sensed voltage is below the reference voltage, the comparator 38 switches its output at 408 to indicate that the reference voltage is higher than the sensed voltage. This change in comparator output triggers the rest of the circuit 60 to then restart the low battery trouble signal at 410 unless a new battery has been installed.

Figure 5A:
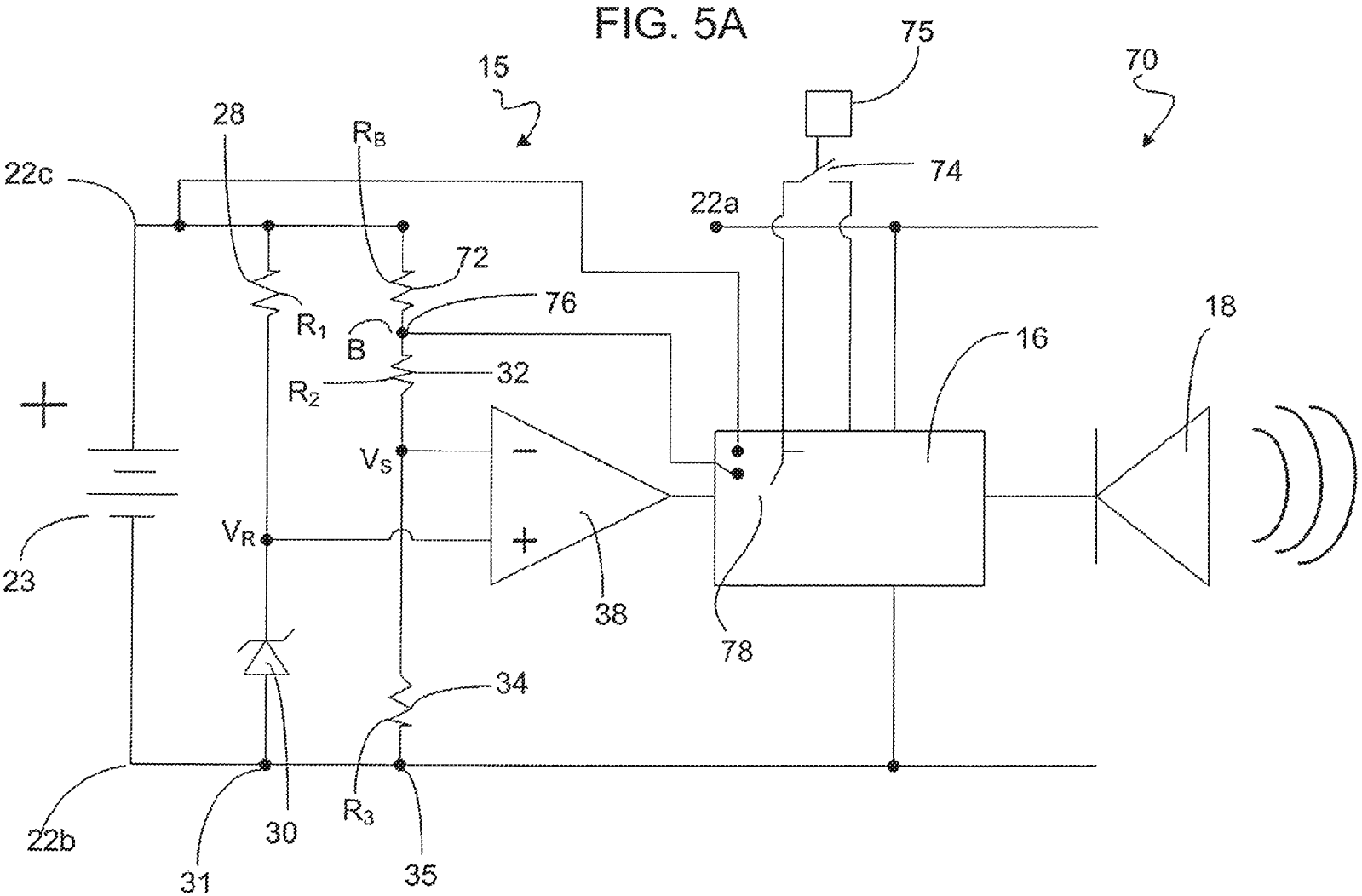
FIG. 5A is a circuit diagram for another embodiment of the present detector.

FIG. 5A shows another embodiment of the present low battery sensing circuit, generally designated 70. Components shared with the circuits 24, 60 are designated with identical reference numbers. The circuit configuration in FIG. 5A adds resistor $R_B$ 72 to the common low battery voltage sensing circuit in FIG. 3A in the second voltage divider 35. Resistor $R_B$ 72 is connected to second and third resistors 32 and 34 in the second voltage divider 35 in series. It is contemplated that the resistance value of the resistor $R_B$ 72 is in the range of 2-5% of the resistance value sum of resistors 32 and 34.

In addition, the circuit 70 also has an activator 74, shown schematically as a delay switch, connected to the activator circuit 16. A non-tactile input mechanism 75 is connected to the delay switch 74. The delay switch 74 is also connected to the second voltage divider 35 between the second resistor 32 and resistor $R_B$ 72, herein referred to as junction B 76 through a switch, schematically shown at 78. It is preferred that the delay switch 74 is configured to toggle between an open and closed position depending on the presence of the battery 23 or manual activation when the battery is absent. The activator circuit operates the switch 78, across the resistor $R_B$ 72. In the delay switch 74 non-activated (when the battery is present) position, the switch 78 across resistor $R_B$ 72 is open. When the delay switch 74 is in the activated (when the battery is absent) position, the switch 78 across resistor $R_B$ 72 is closed.

Operation of the second delay switch circuit 70 is illustrated in FIG. SB and is generally designated as 500. Steps 502-510 are identical to steps 302-310 showing the operation of the low battery voltage sensing circuit 300. However, once the comparator 38 outputs the low voltage signal to the activator circuit 16 to generate the low battery trouble signal at 510, the delay circuit 70 checks at 512 for an activating event 514.

Figure 5B:
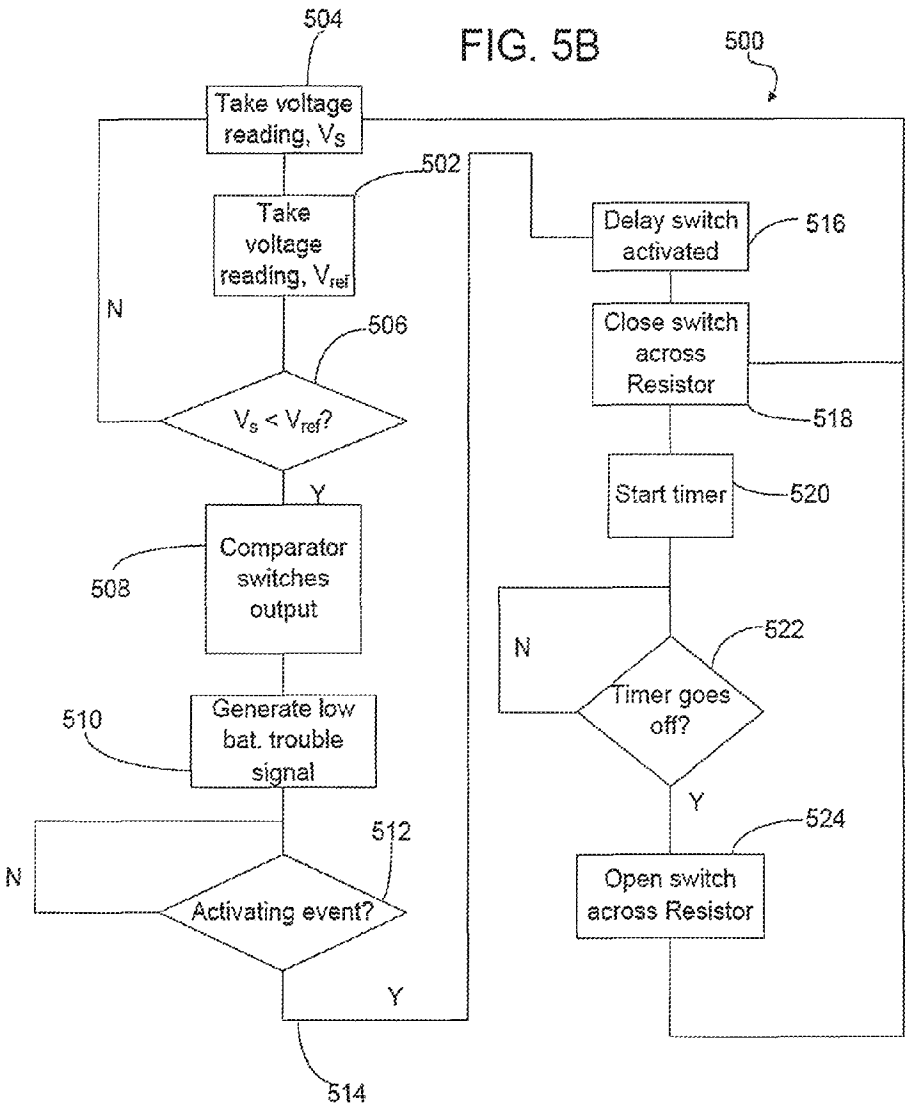
FIG. 5B is a flowchart describing the operation of FIG. 5A.

The operation in FIG. 5B first senses the low battery voltage, as described in FIG. 3B, and generates a low battery trouble signal 510. After the low battery trouble signal is generated, the system checks whether an activating event has occurred 512. If an activating event has not occurred, the trouble signal continues to be generated 510. If the activating event occurs 514, the delay switch 74 is activated and closed at 516, and the switch 78 across resistor $R_B$ 72 is closed 518.

Because the switch 78 across resistor $R_B$ 72 is closed 518, the sensed voltage in the second voltage divider 35 increases. Therefore, the increase in sensed voltage in the second voltage divider 35 makes it seem as though the battery voltage from the voltage source 23 has not decreased when the system is repeating the sensed and reference voltage measurements 502, 504. The comparator 38 receives the sensed voltage and the reference voltage, and compares the two voltages 506. Thus, the comparator 38 indicates that the sensed voltage is higher than the reference voltage when the delay switch is activated 516, and there is no change in output of the comparator 38. Without the change in comparator output, the circuit 70 does not begin the low battery trouble signal.

When the delay switch 74 is activated 516, a timer in the activator circuit 16 starts at 520. The timer in the activator circuit 16 keeps the switch 78 closed across resistor $R_B$ 72 for a silencing time period until the timer in the activator circuit 16 times out at 522. After the timer in the activator circuit 16 times out at 522, the switch 78 is opened at 524. Therefore, the sensed voltage in the second voltage divider 35 decreases. When the system 500 again takes the sensed and reference voltage measurements 502, 504, the comparator 38 compares the decreased sensed voltage and the reference voltage 506. When the sensed voltage is below the reference voltage, the comparator 38 switches its output 508 to indicate that the reference voltage higher than the sensed voltage. This change in comparator output triggers the rest of the circuit 70 to then restart the low battery trouble signal at 512 unless a new battery has been installed.

Figure 6A:
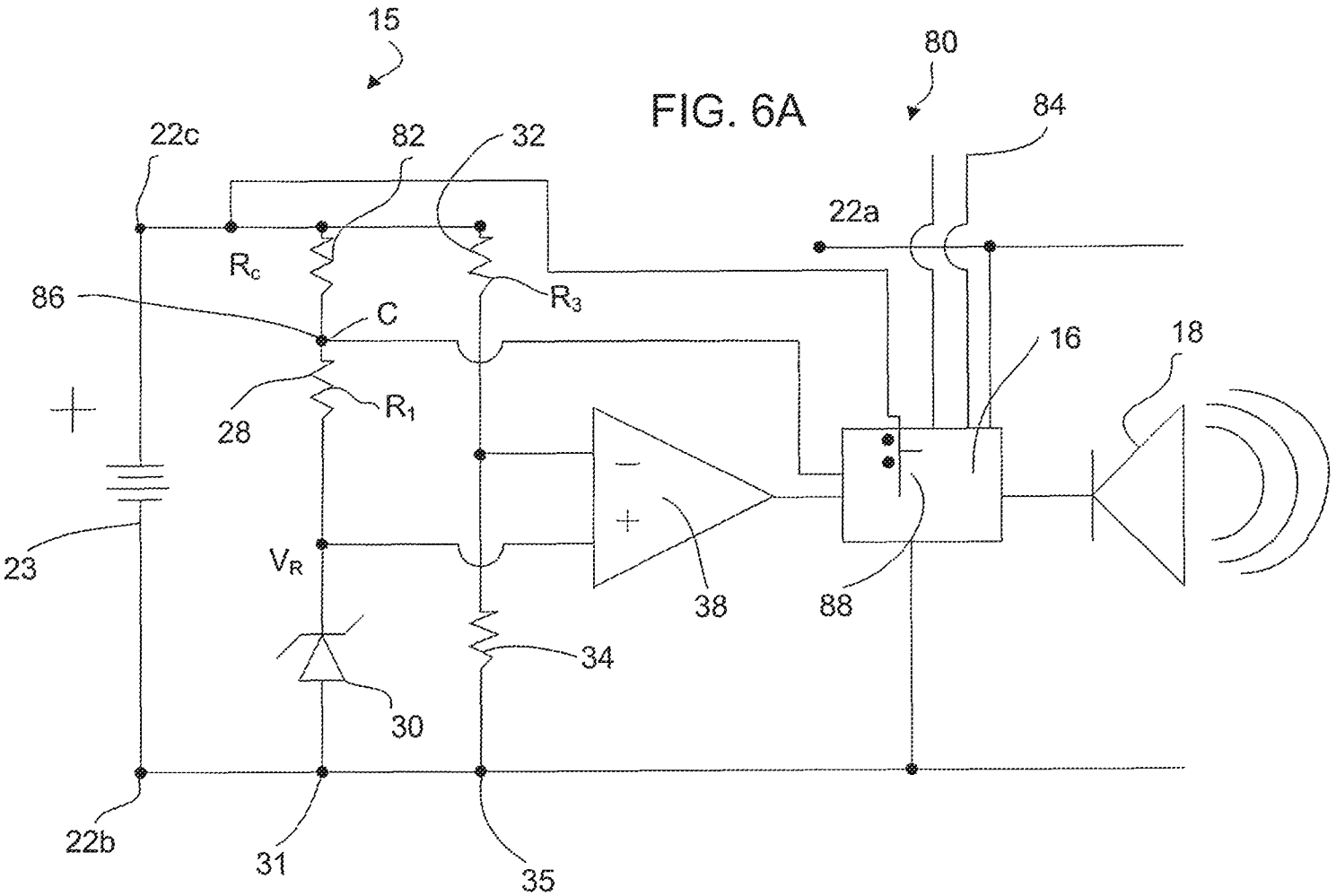
FIG. 6A is a circuit diagram for another embodiment of the present detector.

FIG. 6A shows another embodiment of the present low battery sensing circuit, generally designated 80. The circuit configuration in FIG. 6A and in this embodiment adds resistor $R_C$ 82 to the common low battery voltage sensing circuit in FIG. 3A in the first voltage divider 31. Resistor $R_C$ 82 is connected to the first resistor 28 and the zener diode 30 in the first voltage divider 31 in series. Resistor 82 is chosen to reduce the zener voltage slightly. In addition, the circuit 80 has an activator 84, schematically depicted as a delay switch, connected to the activator circuit 16 and the first voltage divider 31 between the first resistor 28 and resistor $R_C$ 82, here referred to as junction C 86. The delay switch 84 is configured to toggle between an open and closed position depending on the presence of a battery or an activation of switch 84 in the absence of the battery 23. The activator circuit 16 operates a switch schematically designated at 88 across the resistor $R_C$ 82. In the delay switch 84 battery absent position, or battery absent combined with a manual activation of switch 84, the switch 88 across resistor $R_C$ is opened. When the switch 84 is in the battery present position, the switch 88 across resistor $R_C$ 82 is closed.

Figure 6B:
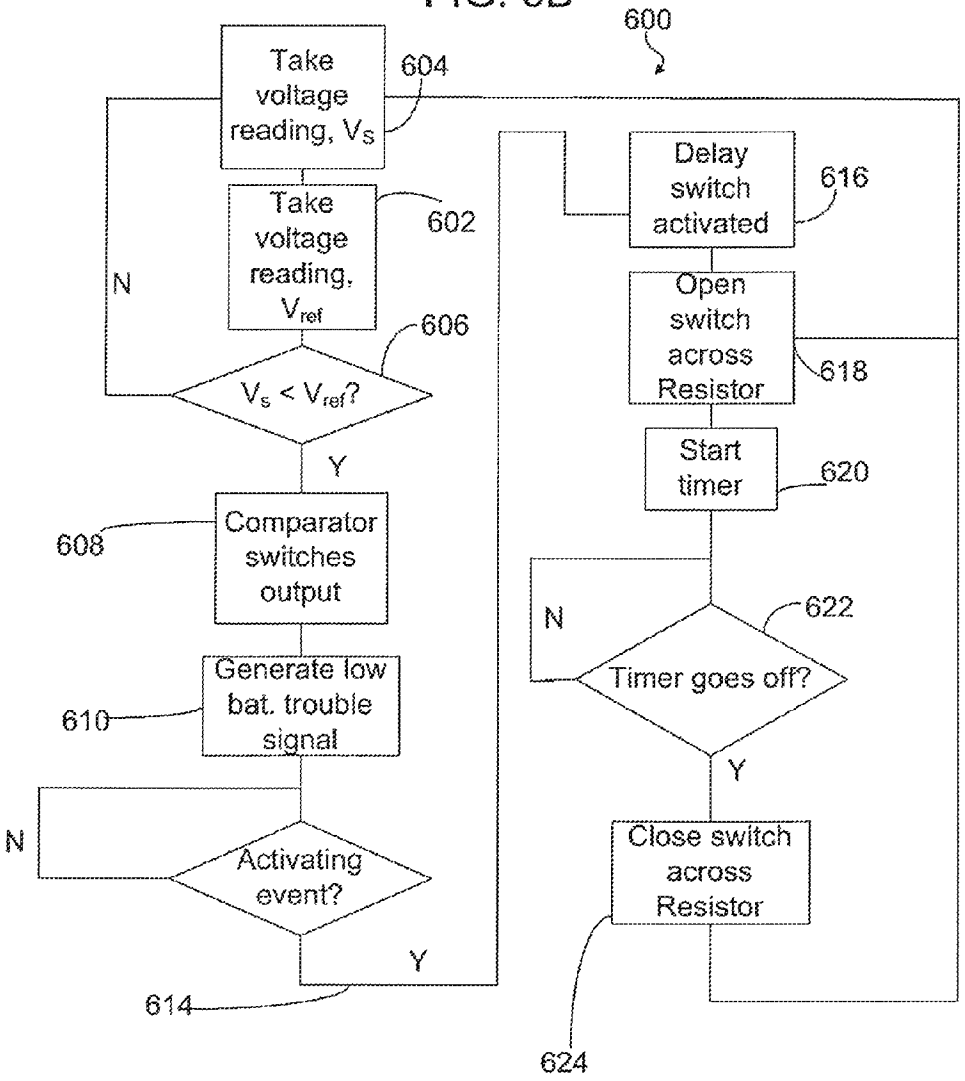
FIG. 6B is a flowchart describing the operation of FIG. 6A.

Operation of the third delay switch circuit 80 is illustrated in FIG. 6B and is generally designated as 600. Steps 602-610 are identical to steps 302-310 showing the operation of the low battery voltage sensing circuit 300. However, once the comparator outputs the low battery voltage signal to the activator circuit 16 to generate the low battery trouble signal at 610, the delay circuit 80 checks at 612 for an activating event at 614. If an activating event has not occurred, the low battery trouble signal continues to be generated at 610. If the activating event occurs, the delay switch 84 is activated at 616, and the switch 88 across resistor $R_C$ 82 is opened at 618. Because the switch 88 across the resistor $R_C$ 82 is opened, the current traveling through the zener diode 30 is decreased. When the amount of current going through the zener diode 30 is decreased, the zener diode 30 holds lower voltage. Those skilled in the art would expect that this relationship is particular to each zener diode.

Therefore, because the zener diode 30 holds a lower voltage, the reference voltage in the first voltage divider 31 decreases when the system is repeating the sensed and reference voltage measurements 602, 604. The comparator 38 receives the sensed voltage and the reference voltage, and compares the two voltages 606. Because the reference voltage has been decreased, the comparator 38 will indicate that the sensed voltage is higher than the reference voltage. The comparator 38 does not send an output signal to activate the low battery trouble signal, and the low battery trouble signal remains inactivated as long as the switch 88 across resistor $R_C$ 82 is opened and the sensed voltage remains higher than the reference voltage.

When the delay switch 84 is activated at 616, a timer in the activator circuit 16 starts at 620. The timer in the activator circuit 16 keeps the switch 88 across resistor $R_C$ 82 opened until the timer in the activator circuit 16 times out at 622. During the silencing time period, the reference voltage is decreased. If the sensed voltage still falls below the decreased reference voltage during the time period, the comparator 38 will still send an output signal to activate the low battery trouble signal. After the timer in the activator circuit 16 times out at 522, the switch 88 is closed. Therefore, the reference voltage in the first voltage divider 31 increases. When the system again takes the sensed and reference voltage measurements 602, 604, the comparator 38 compares the sensed voltage and the increased reference voltage 606. When the sensed voltage is below the reference voltage, the comparator 38 switches its output 608 to indicate that the reference voltage is higher than the sensed voltage. This change in comparator output triggers the rest of the circuit 80 to then restart the low battery trouble signal 610 unless a new battery has been installed.

Figure 7A:
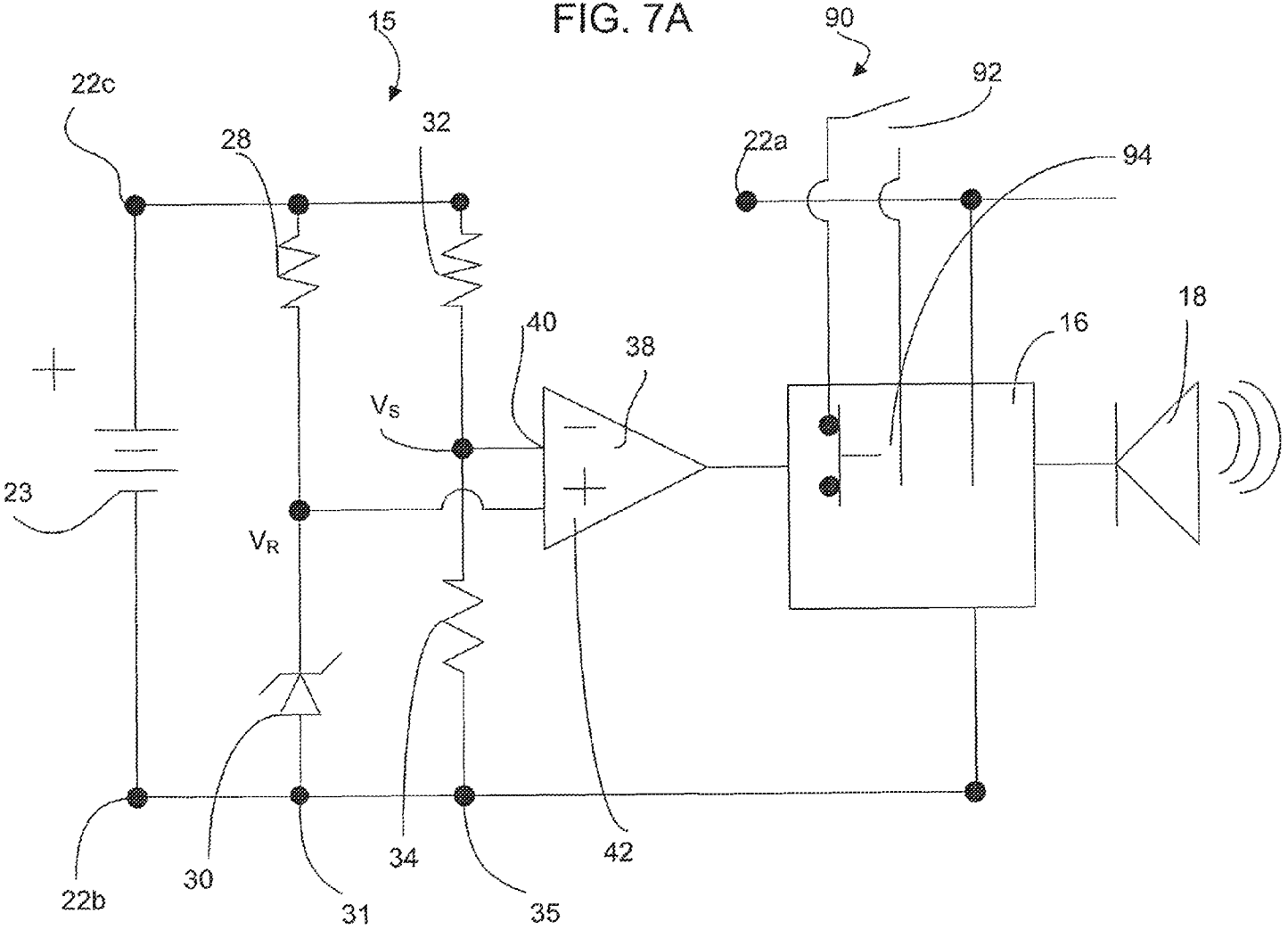
FIG. 7A is a circuit diagram for another embodiment of the present detector.

FIG. 7A shows another embodiment of the present low battery sensing circuit, generally designated 90. To the common sensing circuit illustrated in FIG. 3A, this embodiment features an activator 92, schematically depicted as a low battery trouble signal delay switch, a delay timer, and a lockout device that includes a lockout switch 94 and a lockout timer, generally designated as part of the activator circuit 16. FIG. 7A shows that the lockout switch and both timers can reside in the activator circuit 16. Those skilled in the art should recognize that the delay and lockout switches and timers can also be made up of discrete components or unique integrated circuits, instead of as part of the activator circuit 16. The delay switch 92 is configured to toggle between an open and a closed position. When the delay switch 92 is in a battery absent position or a battery absent plus a manual activation of switch 92, the activator circuit 16 is designed to temporarily delay a low battery trouble signal.

Figure 7B:
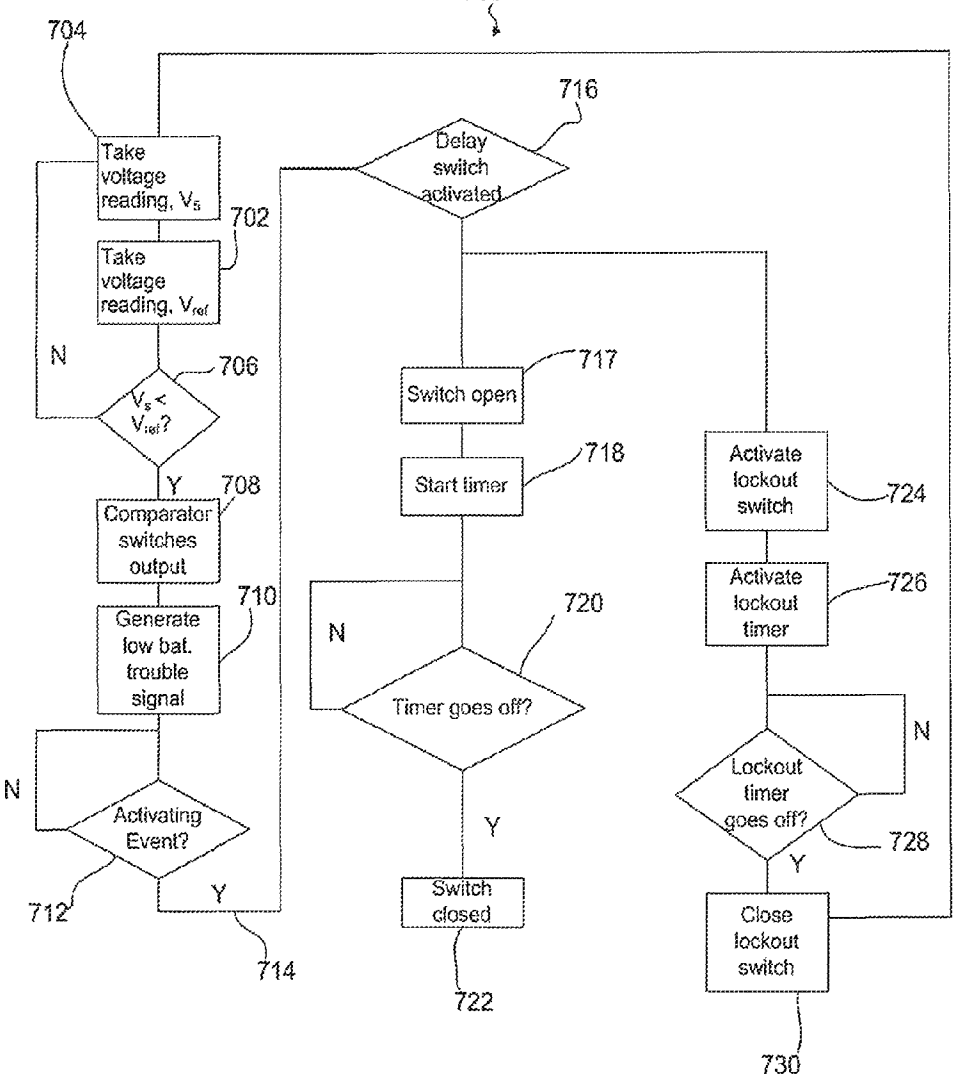
FIG. 7B is a flowchart describing the operation of FIG. 7A.

Operation of the fourth delay switch circuit 90 is illustrated in FIG. 7B and is generally designated as 700. Steps 702-710 are identical to steps 302-310 showing the operation of the low battery voltage sensing circuit 300. After the low battery trouble signal is generated at 710, and the circuit 90 checks at 712 for an activating event at 714, the delay switch 92 is activated and opened at 716 and 717. The activation of the delay switch 92 at 716 also starts the delay timer in the activator circuit 16 at 718. When the delay timer times out at 720, the circuit reverts back to a low battery voltage signal not being delayed mode.

After the low battery voltage delay switch has been activated at 716, the lockout switch 94 is opened for a predetermined lockout time period at 724. In a preferred embodiment, the lockout switch 94 is a second switch connected in series with the delay switch 92 that opens after the delay switch 92 had been activated at 716. It is contemplated that this lockout time period is longer than a few days. The lockout switch 94 opens the circuit to the delay switch 92, meaning that while the lockout switch 94 is open, the delay switch 92 cannot be activated. This prevents reactivation of the activator after a first activation, preventing a user from delaying the low battery trouble signal a second time. The lockout timer keeps the lockout switch 94 open for the predetermined lockout period, and is activated at 726 once the lockout switch 94 is activated 724. The lockout switch 94, after the predetermined lockout time period ends at 728, automatically closes at 730.

Figure 8A:
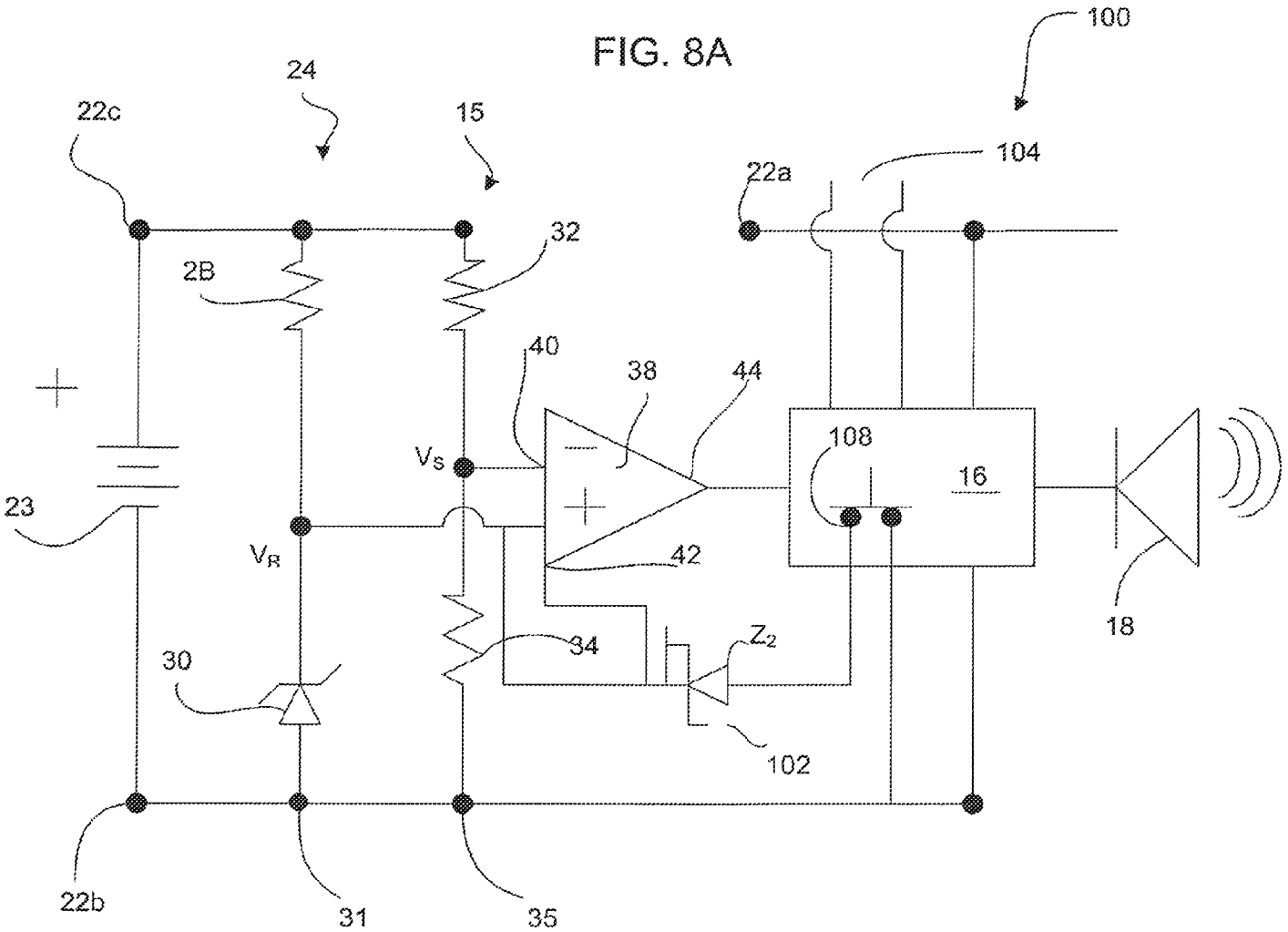
FIG. 8A is a circuit diagram for another embodiment of the present detector.

Referring now to FIG. 8A, another embodiment of the low battery sensing circuit is generally designated 100. Components shared with the circuits 24, 60 are designated with identical reference numbers. The circuit configuration in FIG. 8A adds an additional zener diode 102, $Z_2$. The zener diode $Z_2$ 102 has a slightly lower voltage value than zener diode 30. The circuit 100 also includes an activator 104, here depicted schematically as a low battery voltage trouble signal delay switch, connected to the activator circuit 16 and to the first voltage divider 31 between the first resistor 28 and 22*b* ground. The zener diode $Z_2$ 102 is connected to the first voltage divider at 31, between the resistor 28 and zener diode 30. The activator circuit 16 operates a switch, schematically depicted at 108, configured to toggle between an open and closed position depending on the condition of the activator switch 104. The switch 108 connects the anode of zener diode $Z_2$ 102 to ground, 22*b*. When the activator 104 has not been activated, the switch 108 is in the open position, the corresponding voltage at junction 106 is the voltage rating of zener diode 30. When the activator 104 is activated, the switch 108 is in the open position, the junction 106 voltage is the lower voltage of zener diode $Z_2$ 102.

Figure 8B:
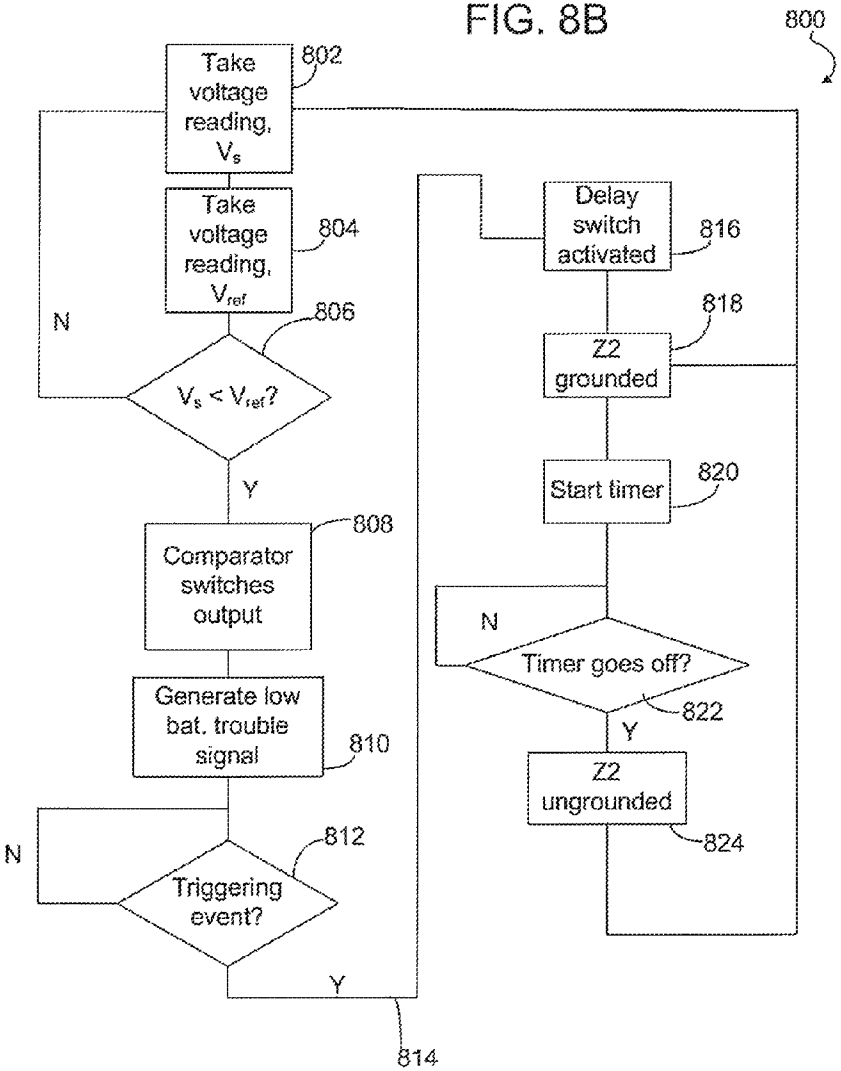
FIG. 8B is a flowchart describing the operation of FIG. 8A.

Referring now to FIG. 8B, operation of the first delay switch circuit 100 is generally designated as 800. Steps 802-810 are identical to steps 302-310 showing the operation of the low battery voltage sensing circuit 300. However, once the comparator 38 generates the low battery voltage signal to the activator circuit 16 to activate the low battery trouble signal at 810, the delay circuit 100 checks 812 for an activating event 814, in which the delay switch 104 is activated upon receiving a first input. Examples of the activating event 814 include removing the battery 23 from the detector 10. Additional examples of the activating event 814 are described here. If no activating event 814 has occurred, the low battery trouble signal is sounded at 18. If the activating event occurs 814, the delay switch 104 is activated 816 and the anode of zener diode 102 is grounded 818.

Since the anode of zener diode 102 is grounded, the reference voltage, $V_R$, at the first voltage divider 31 decreases. Therefore, the decrease in reference voltage, $V_R$, at the first voltage divider 31 makes it seem as though the battery voltage from the voltage source 23 has not decreased sufficiently when the system is repeating the sensed and reference voltage measurements at 802, 804. The comparator 38 receives the sensed voltage in the second voltage divider 35 and the reference voltage in the first voltage divider 31, and compares the two voltages at 806. Thus, the comparator 38 indicates that the sensed voltage is higher than the reference voltage when the delay switch 104 is activated, and there is no change in output of the comparator 38. Without the change in comparator output, the activator circuit 16 does not activate the low battery trouble signal.

When the delay switch 104 is activated at 816, a timer in the activator circuit 16 starts at 820. The timer in the activator circuit 16 keeps the switch 108 connecting the anode of zener diode 102 to 22*b*, ground for a silencing time period until the timer in the activator circuit 16 times out at 822. After the timer in the activator circuit 16 times out 822, the switch 108 is opened, causing the anode of zener diode 102 to be ungrounded again at 824. Therefore, the reference voltage in the first voltage divider 31 increases. When the system 800 again takes the sensed and reference voltage measurements at 802, 804, the comparator 38 compares the sensed voltage and the increased reference voltage at 806. When the sensed voltage is below the reference voltage, the comparator 38 switches its output at 808 to indicate that the reference voltage is higher than the sensed voltage. This change in comparator output triggers the rest of the circuit 100 to then restart the low battery trouble signal at 810 unless a new battery has been installed.

In FIGS. 4B-8B, the system 400, 500, 600, 700, 800 checks whether an activating event has occurred after generating a low battery trouble signal. The activating event, as used here, is a user input that temporarily disables the audible low battery voltage signal. It is contemplated that this optionally includes removing the battery from the detector 10.

Referring back to FIG. 5A, a non-tactile input mechanism 75 is connected to the activator 74, and is configured to detect a non-tactile input and send a signal to the activator 74. It is contemplated that any of the activators 64, 74, 84, 92, and 104 are connected to and can receive signals from a non-tactile input mechanism. The non-tactile input mechanism 75 includes, but is not limited to: a proximity sensor, and the activating event is moving an object, such as a user's hand, in the vicinity of the proximity sensor in the detector 10, an optical sensor, and the activating event is shining a light into the optical sensor, an acoustic sensor, and the activating event is playing a sound, or a radio receiver, and the activating event is sending a radio signal to the radio sensor on the detector.

While a particular embodiment of the present low battery alarm delay in smoke detectors has been described herein, it will be appreciated by those skilled in the art that changes and modifications may be made thereto without departing from the invention in its broader aspects and as set forth in the following claims.

What is claimed:

1. A low battery trouble signal delay circuit for a smoke detector configured for periodically measuring environmental conditions and for producing a fire alarm signal when smoke is detected in the environment, said trouble signal delay circuit comprising:

a battery;

a comparator configured for receiving a voltage measurement signal from the battery and a reference voltage measurement signal and sending a resulting signal to an activator circuit;

at least one activator in said activator circuit that is user activated upon receiving a first input;

at least one low battery trouble signal annunciator connected to the activator circuit and configured for indicating that the voltage measurement signal is below the reference voltage measurement after receiving a signal from the comparator; and a lockout device connected to the activator circuit for temporarily preventing reactivation of the activator after the activation, wherein the activator temporarily disables the low battery trouble signal when activated for a predetermined silencing time period, while maintaining the operation of the fire alarm signal, and the activator circuit automatically enables the low battery trouble signal at the end of the predetermined silencing time period.

2. The smoke detector system of claim 1, wherein said activator circuit is configured such that after the activation of the activator the voltage measurement signal from the battery is increased.

3. The smoke detector system of claim 1, wherein said activator circuit is configured such that after the activation of the activator the reference voltage measurement is decreased.

4. The smoke detector system of claim 1, further including a non-tactile input mechanism connected to the activator.

5. The smoke detector system of claim 4, wherein the non-tactile input mechanism is selected from the group consisting of: a proximity sensor, an optical sensor, an acoustic sensor, and a radio receiver.

6. The smoke detector system of claim 1, wherein the circuit is configured so that the battery is loaded periodically while the voltage measurement signal and the reference voltage measurement signal are being compared.

7. A low battery trouble signal delay circuit for a smoke detector configured for periodically measuring environmental conditions and for producing a fire alarm signal when smoke is detected in the environment, said trouble signal delay circuit comprising:

a battery;

a comparator configured for receiving a voltage measurement signal from the battery and a reference voltage measurement signal and sending a resulting signal to an activator circuit;

at least one activator in said activator circuit that is user activated upon receiving a first input; and at least one low battery trouble signal annunciator connected to the activator circuit and configured for indicating that the voltage measurement signal is below the reference voltage measurement after receiving a signal from the comparator, wherein the low battery trouble signal circuit temporarily changes the voltage measurement signals the comparator receives, disables the low battery trouble signal annunciator when activated for a predetermined silencing time period, and the low battery trouble signal circuit automatically enables the low battery trouble signal annunciator at the end of the predetermined silencing time period, wherein the length of the predetermined silencing time period is independent from the voltage signal voltage signal from the battery.

8. A method for temporarily silencing a low battery trouble signal in a smoke detector, comprising:

providing a comparator and an activator circuit for operating the smoke detector;

said comparator periodically receiving a voltage measurement signal from a battery in the smoke detector;

said comparator comparing the voltage measurement signal to a reference voltage signal and sending a resulting signal to the activator circuit;

said activator circuit activating a low battery trouble signal when the voltage measurement signal is less than the reference voltage signal; and said activator circuit checking for an activating event after said activation of the low battery trouble signal, wherein, if the activating event occurred, the low battery trouble signal is disabled for a predetermined silencing time period and the receiving, comparing, enabling, and checking steps are repeated, and the low battery trouble signal is automatically enabled at the end of the predetermined silencing time period, wherein the predetermined silencing time period is followed by a lock-out time period before repeating the receiving, comparing, enabling, and checking steps.

9. The method of claim 8, wherein the activating event causes the activator circuit to disable the low battery trouble signal for the predetermined silencing time period by increasing the voltage measurement signal.

10. The method of claim 8, wherein the activating event causes the activator circuit to disable the low battery trouble signal for the predetermined silencing time period by decreasing the reference voltage measurement signal.

* * * * *